US011497329B2

(12) United States Patent
Shirazi

(10) Patent No.: US 11,497,329 B2
(45) Date of Patent: Nov. 15, 2022

(54) DISPOSABLE PLATES MADE OF DISPOSABLE PIECES

(71) Applicant: Mobin Shirazi, Canoga Park, CA (US)

(72) Inventor: Mobin Shirazi, Canoga Park, CA (US)

( * ) Notice: Subject to any disclaimer, the term of this patent is extended or adjusted under 35 U.S.C. 154(b) by 0 days.

(21) Appl. No.: 17/090,287

(22) Filed: Nov. 5, 2020

(65) Prior Publication Data

US 2022/0133066 A1 May 5, 2022

(51) Int. Cl.
*A47G 19/03* (2006.01)
*A47G 19/08* (2006.01)

(52) U.S. Cl.
CPC ..... *A47G 19/03* (2013.01); *A47G 19/08* (2013.01)

(58) Field of Classification Search
CPC ..... A47G 19/03; A47G 19/08; B65D 75/08
USPC ..... 220/574
See application file for complete search history.

(56) References Cited

U.S. PATENT DOCUMENTS 2,895,601 A * 7/1959 Krukonis ..... B65D 85/1072 229/87.06

* cited by examiner

*Primary Examiner* — Andrew D Perreault
(74) *Attorney, Agent, or Firm* — Dana Legal Services; Jubin Dana

(57) ABSTRACT

An apparatus is disclosed that prevents the waste of disposable culinary pieces. According to various aspects and embodiments of the invention the apparatus can facilitate either leisurely disbursement of pieces for a small or medium size event, or for rapid disbursement of pieces for large events.

4 Claims, 17 Drawing Sheets

DISPOSABLE PLATES MADE OF DISPOSABLE PIECES

FIELD OF THE INVENTION

The present invention is in the field of culinary implements, and, more specifically, to disposable plates, made of disposable pieces.

BACKGROUND

Today's society values disposable pieces for a sanitary and convenient eating surface while picnicking, travelling, moving in or out of a new residence, entertaining at home, during working lunches and for many other situations. Most, if not all, disposable pieces are loosely stacked one on top of the other in plastic wrapped packages. These pieces, once the plastic wrapping is removed, are rendered unstable and can be easily spilled, or can be blown away by the movement of the air. In either case, the disposable pieces become soiled or lost and rendered unusable. When considering the millions of disposable pieces in use every day, and the proportion of them that are lost due to spillage or being blown away, the financial loss, though perhaps small for each individual user, is significant when taken in the aggregate across society. Environmentally considered, this same loss of pieces creates significant waste of disposable piece manufacturing materials, thus accelerating the depletion of forests and other manufacturing resources such as the energy and cost needed to produce each lost piece. Therefore, what is needed are disposable pieces that reduce waste caused by disposable pieces and at the same time allow for the benefits of disposability.

SUMMARY OF THE INVENTION

In accordance with various aspects of the invention, disposable pieces are provided that reduce waste and maintain the convenience and cleanliness of disposability. An article of manufacture is provided that includes a rigid base that removably adheres or attaches to a plurality of layers (stack) of disposable pieces on each surface of the base that act as new disposable pieces. The rigid base removably adheres to the piece adjacent to the base, while each next piece in the stack, proceeding away from the base, adheres to each previous piece in the stack that is closer to the base. The piece furthest from the base can be peeled from the next piece closer to the base by a user. The lowest piece in the stack that adheres to the base can also be used by peeling it from the base.

Furthermore, according to the various aspects and embodiments of the invention, the stack of disposable pieces can removably adhere to one side of a flat or flanged base, or to both sides of a two-sided flat or flanged base.

According to the various aspects and embodiments of the invention, the removable pieces can be attached to one other and to the base to form a stack of removably attached pieces by other methods, such as by zip fasteners.

The entire assembly of the pieces attached to one another and to the base forms a stack of disposable pieces that, once the plastic wrapper is removed, cannot be easily upended, and spilled, or blown away by the wind or other air movement. Thus, the above described assembly of base and removably adhered or attached disposable pieces is convenient to use and prevents the loss of pieces due to spillage, dropping of the stack of pieces, and/or the pieces being blown away by the wind or loss of the pieces due to other similar events.

DETAILED DESCRIPTION

Figure 1:
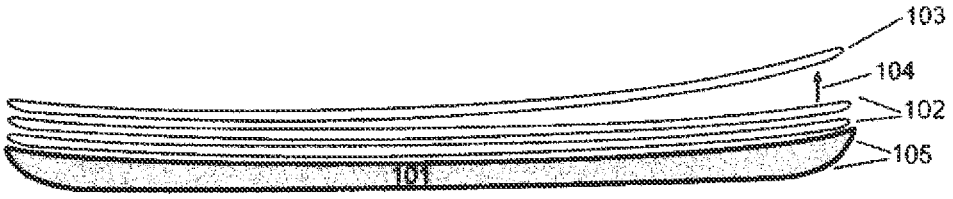
FIG. 1 shows a base with a stack of disposable pieces that adhere to one side of the base and to each next disposable piece ascending away from the base according to various aspects and embodiments of the invention.

To the extent that the terms "including", "includes", "having", "has", "with", or variants thereof are used in either the detailed description and the claims, such terms are intended to be inclusive in a similar manner to the term "comprising". The invention is described in accordance with the aspects and embodiments in the following description with reference to the figures, in which like numbers represent the same or similar elements. Reference throughout this specification to "one embodiment," "an embodiment," or similar language means that a particular feature, structure, or characteristic described in connection with the various aspects and embodiments are included in at least one embodiment of the invention. Thus, appearances of the phrases "in one embodiment," "in an embodiment," "in certain embodiments," and similar language throughout this specification refer to the various aspects and embodiments of the invention. It is noted that, as used in this description, the singular forms "a," "an" and "the" include plural referents, unless the context clearly dictates otherwise.

In the current application, the term "removably adhered" and "adhered" have the same meaning. Either term means that the disposable pieces adhere to one another and to the base in such a manner that the uppermost disposable piece in a stack can be easily peeled or removed by other means from the disposable piece below it and the innermost piece in the stack can be easily peeled or removed by other means from the rigid base. Likewise, the term "disposable piece" and "piece" have the same meaning in that they both refer to disposable dining pieces that can be used as a plate. When referring to the instant invention, the term "removably adhered (or adhering) or removably attached disposable piece" has the same meaning as "disposable piece" and "piece." Also, the term "rigid base" has the same meaning as "base."

The described features, structures, or characteristics of the invention may be combined in any suitable manner in accordance with the aspects and one or more embodiments of the invention. In the following description, numerous specific details are recited to provide an understanding of various embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring the aspects of the invention.

All publications and patents cited in this specification are herein incorporated by reference as if each individual publication or patent were specifically and individually indicated to be incorporated by reference and are incorporated herein by reference to disclose and describe the methods and/or system in connection with which the publications are cited. The citation of any publication is for its disclosure prior to the filing date and should not be construed as an admission that the invention is not entitled to antedate such publication by virtue of prior invention. Further, the dates of publication provided may be different from the actual publication dates, which may need to be independently confirmed.

Now referring to FIG. 1, according to various aspects and embodiments of the invention, it can be embodied (1), as a stack of disposable pieces 102 that adhere by a non-toxic adhesive, or by other means, to one another and to a rigid structure or base 101, where the bottom of each piece 103 adheres to the top of the piece just below it in the stack 102. The bottom of the piece in the stack adjacent to the base 101 adheres to the base 101, thus making the stack of pieces, and the base one unit, until each individual top piece 103 is peeled 104 from the piece below it in the stack 102. The lowest piece in the stack 102 is peeled from the base 101. In accordance with an embodiment of the invention, the base 101 can be the same shape as the pieces that adhere to it, and can be flanged 105 in an upward direction at the base's outer circumference to match the upward flange around the circumference of each piece in the stack.

Disposable pieces adhering to the base 101 and to one another provides a significant improvement over currently available disposable pieces because the adhering disposable pieces will not slip and fall to the floor if tilted while used inside a structure, or spill to the ground if tilted out of doors. A stack of adhering disposable pieces will not be easily blown away by a strong air current or wind inside of a structure or blown away by the wind outdoors. On the other hand, traditional, loosely stacked, disposable pieces can easily be tilted and spilled to the floor inside or to the ground outside. Traditional, loosely stacked, disposable pieces can also be easily blown away, by a strong air current inside a structure or by a moderate breeze outside, for example, at a picnic. Overall, the widespread use of traditional, loosely stacked, disposable pieces contributes to a significant number of lost, discarded, and therefore, unused disposable pieces across the country and around the world. This loss of traditional, loosely stacked, disposable pieces contributes to a waste of financial resources to the individual purchaser, and to wasted materials and energy used in producing the lost disposable pieces.

Figure 2:
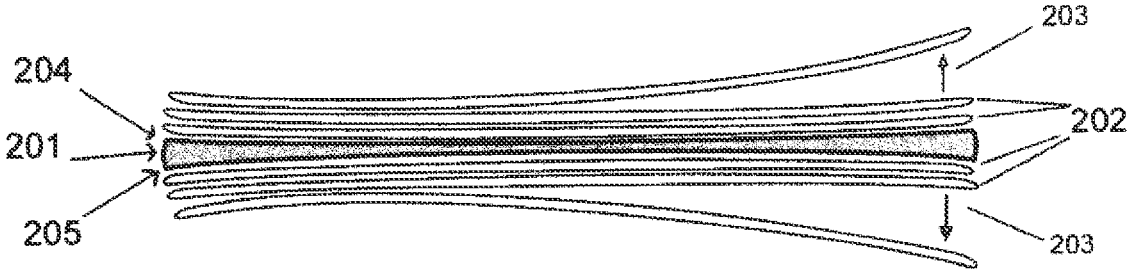
FIG. 2 shows a base with two stacks of disposable pieces with each stack adhering to one of the two sides of the base, where each succeeding disposable piece in each stack adheres to the next disposable piece in its respective stack and to its respective base according to various aspects and embodiments of the invention.

Now referring to FIG. 2, according to various embodiments of the invention, the rigid base 201 can be flanged upward 204 on its outer circumference on its top and flanged downward 205 on its outer circumference on its bottom. In this embodiment of the invention, the shape of each individual disposable piece in each stack of disposable pieces will be of the same shape as it's respective base with an outward flange 204, 205 around its circumference. The pieces 202 adhered to the upper side of the base and the pieces 202 adhered to the lower side of the base can be peeled 203 from one another and from their respective side of the base 201.

The advantage of this embodiment of the invention, in addition to the above mentioned advantages of not spilling and not being blown away, include, but are not limited to: by adhering both sides of the base 201, more pieces can be adhered to one base, therefore lowering the manufacturing cost of producing each complete unit of pieces and base 201. Lower manufacturing cost should also translate to a lower purchase price for the consumer. Another advantage is that it is more convenient for the purchaser. The purchaser can take one unit containing double the number of individual pieces as compared to an embodiment with disposable pieces on only one side of the base when going to a meeting or to a picnic, etc. This is especially advantageous when many pieces will be used by the people at an event.

Figure 3:
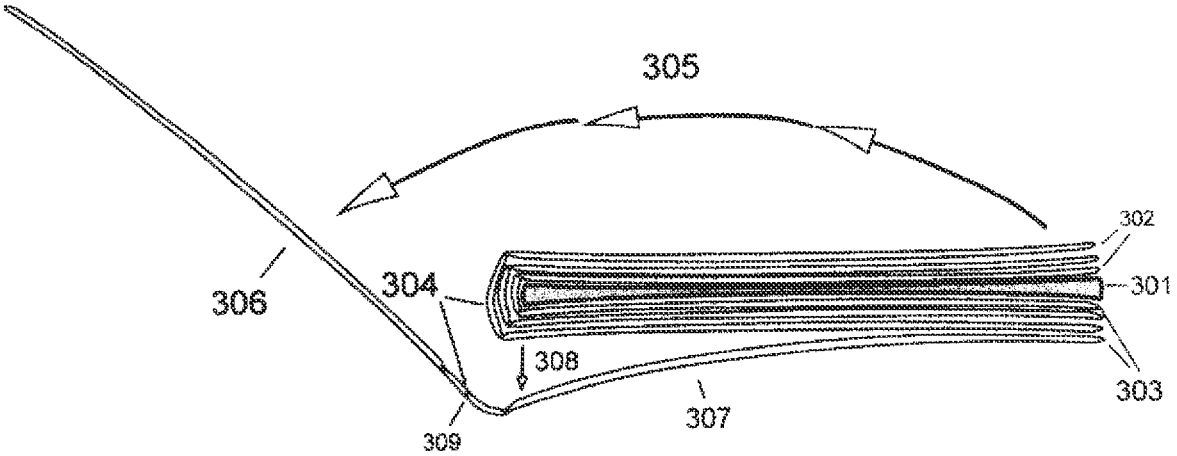
FIG. 3 shows a base that has two sides with a stack of disposable pieces adhering to each of the two sides of the base and to each next adhered piece in the stacks on both sides of the base, where the removal of the first disposable piece from either stack on one side of the base actuates the removal of the first disposable piece from the second stack on the opposite side of the base through the connection of both pieces to a strip of material according to various aspects and embodiments of the invention.

Now referring to FIG. 3, according to various aspects and embodiments of the invention, each adhered piece in the upper stack 302 is connected to a adhered piece in the lower stack 303 by a strip of connecting strip 304 at the same position along the circumference of each corresponding piece. When an outermost piece 306 in the upper stack is peeled 305 from the top of the stack, the connecting strip of material 304 attached to the piece 306 from the upper stack peels the attached corresponding piece 307 from the lower stack that is also attached to the connecting strip of material 304. In this manner two pieces 306 and 307 are peeled from both the upper and lower stacks 302 and 303 on opposite sides of the base 301 in rapid succession. If the user wishes to remove only one piece 306 from a stack, after peeling it 305 from the top stack of disposable pieces, he can tear or cut connecting strip 304 at 309 and avoid peeling off the corresponding piece 307 from the opposite side of base. 301

Figure 4:
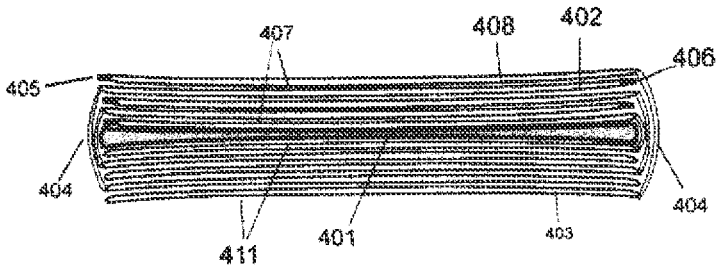
FIG. 4 shows a base that has two sides with a separate stack of disposable pieces on both sides of the base, where each piece in the top stack includes a tab along its circumference, and each next piece in the top stack has a tab on the opposite side of its circumference from the piece above and below it in the stack according to various aspects and embodiments of the invention.

Now referring to FIG. 4, according to various aspects and embodiments of the invention, a tab 405 and a tab 406 is attached to each piece in one stack of disposable pieces 407 that are adhered to the base 401. The only tab visible on the combined stacks of pieces is tab 405 on the outermost piece in only one stack of pieces. The tab 405 is attached to the circumference of the outermost piece 408 in one stack of a two-stack apparatus. The tab 406 is hidden beneath piece 408 and is attached to the edge of the circumference of the piece 402 that is immediately below and adhered to piece 408. The tab 406 is attached to the second piece 402 in the same stack of pieces 407 as tab 405 at a location of one-hundred and eighty degrees around the circumference, (the opposite side) from the tab 405 attached to piece 408. Only one tab, 405, is visible to a user until the outermost piece 408 is peeled from the stack. Then, the tab 406 on the next adjacent piece 402 is visible. Only one tab 405 or 406 is visible at any given time while using the apparatus composed of stacks of pieces 407, 411 and base 401. Each piece in the stack of pieces 407 on one side of the apparatus has a tab 405 or 406 on opposite locations on the circumference, or across the piece, from the piece immediately above and the piece immediately below each piece in the stack of pieces 407. The pieces in the stack of pieces 411 on the opposite side of the base 401 do not have tabs. Consequently, the pieces in the stack 411 on the side of base 401 without tabs are removed by pulling the tabs 405 or 406 located on the circumference of the pieces in the stack of pieces 407 on the other side of the base 401. Consequently, to remove the disposable pieces from both the top and bottom stacks of pieces, there is only one tab 405 or 406 to pull in one stack of disposable pieces 407 on only one side of the base 401. Because there is only one tab available at a time that allows a user to remove pieces from the stacks of disposable pieces this embodiment of the invention is especially advantageous to prevent a user who is a small child from scattering disposable pieces on the floor or on the ground as when accessing traditional disposable pieces.

Figure 5:
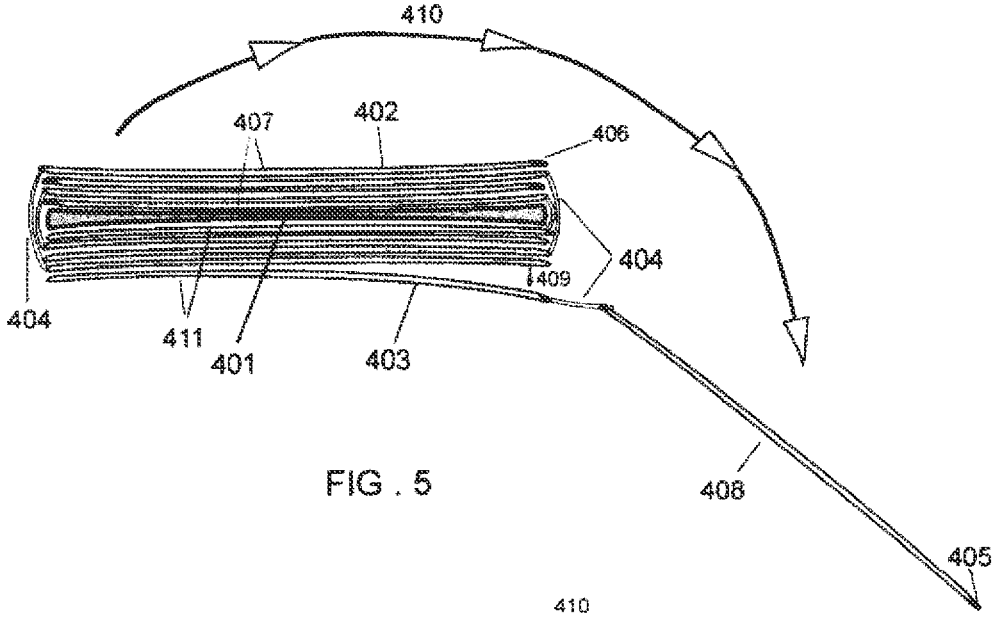
FIG. 5 shows the action of FIG. 4 from one direction of pull of the tab to remove pieces from both the top and bottom stacks of disposable pieces according to various aspects and embodiments of the invention.

Now referring to FIG. 5, showing the action of FIG. 4 according to various aspects and embodiments of the invention. A user removes a top piece 408, by pulling tab 405 and peeling top piece 408 from the stack of pieces 407 on one side of the base 401. The user continues to pull on tab 405 to engage the connecting strip 404 on the outer edge of the assembly of stacks of pieces 407, 411 and base 401, which peels the corresponding piece 403 from the other side of the base 401. 410 indicates the direction of movement when a user peels piece 408 from the stack of pieces 407 on one side of the base 401 by pulling tab 405. 409 indicates the direction of movement when a user continues to pull tab 405, to engage connecting strip 404 to then peel piece 403 from the stack of pieces 411 on the other side of the base 401. Once piece 408 is removed from the stack of pieces 407, the tab 406 is exposed on the edge of the next piece 402 on the same side of the stack from where piece 408 was previously adhered.

Figure 6:
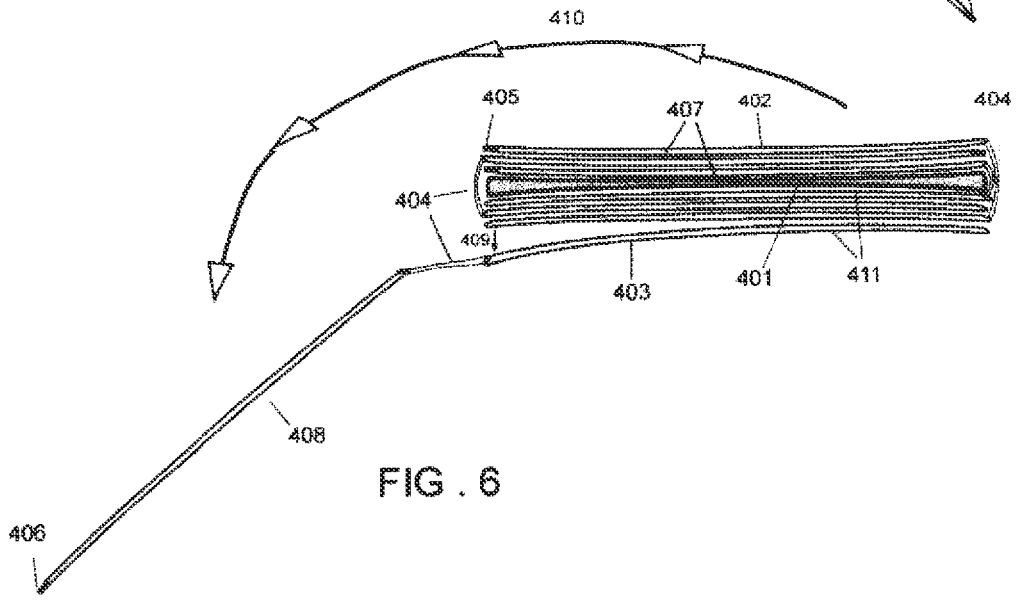
FIG. 6 shows the action of FIG. 4 from the opposite direction of pull of the previously hidden tab on the following disposable piece that remove pieces from both the top and bottom stacks of disposable pieces according to various aspects and embodiments of the invention.

Now referring to FIG. 6, showing the action of FIG. 4, according to various aspects and embodiments of the invention. A user removes a top piece 408, by pulling tab 406 on the opposite side of the stack of pieces 407 from previously pulled tab 405 and peeling top piece 408 from the stack of pieces 407 on one side of the base 401. The user continues to pull tab 406 to engage the connecting strip 404 on the combined edge of the assembly of pieces 407, 411 and of base 401, which peels the piece 403 from the stack of pieces 411 on the other side of the base 401. 410 indicates the direction of movement when a user peels piece 408 from the stack on one side of the base 401 by pulling tab 406. 409 indicates the direction of movement when a user continues to pull tab 406, to engage connecting strip 404 to then peel piece 403 from the stack on the other side of the base 401. Once piece 408 is removed from its side of the stack of pieces 407, the next tab 405 is exposed on the edge of the next piece 402 on the same side of the stack from where piece 408 was previously adhered.

Figure 7A:
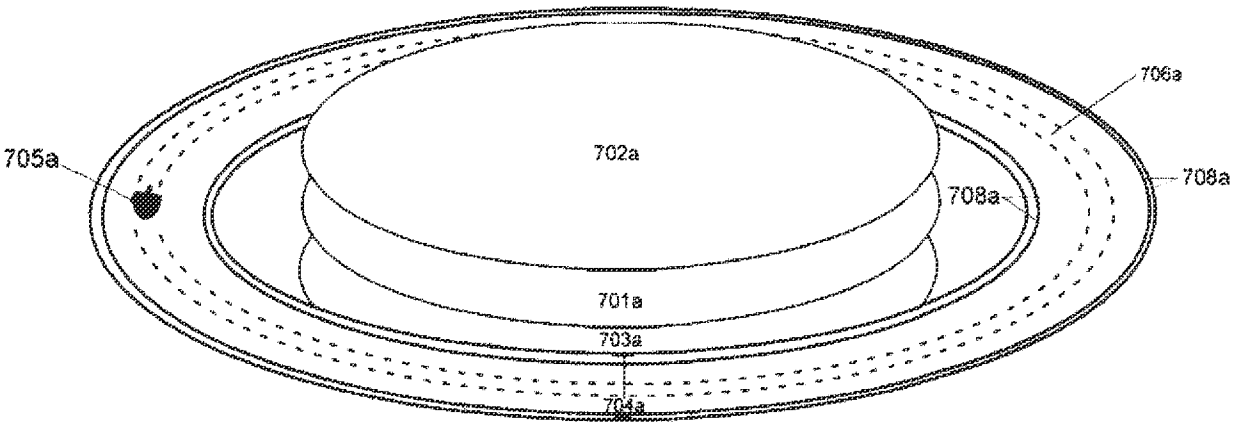
FIG. 7*a* shows an exploded view of an assembly of three pieces that include a central base, an upper piece, and a lower piece connected together around the combined circumferences by a connecting strip that can be opened by pulling a zip tab on a zip fastener or other opening device that opens the connecting strip to separate the top piece and the bottom piece from each stack of disposable pieces and after the stack is exhausted from the central rigid base according to various aspects and embodiments of the invention.

Now referring to FIG. 7*a*. According to various aspects and embodiments of the invention, a top stack of pieces 702*a*, and a bottom stack of pieces 703*a* are positioned onto opposite sides of a base 701*a* and held in place by a connecting strip 704*a*. An individual connecting strip 704*aa* adheres around the circumference of each individual piece in the top stack of pieces 702*a*, and around the circumference of each corresponding individual piece in the bottom stack of pieces 703*a*. Each connecting strip 704*a* keeps each piece on the top stack 702 and each piece on the bottom stack 703 snugly positioned around the base 701*a* holding the whole assembly together. The depth connecting strip 704*a* is depending upon the number of pieces in the top stack of disposable pieces 702*a* and the equal and corresponding number of pieces in the bottom stack of disposable pieces.

Each connecting strip 704*a* includes a zip tab 705*a* attached to a zip fastener or other opening device 706*a* positioned on each piece of stack 702*a*. The zip fastener 706*a* can be opened by a user to remove each top piece of the top stack 702*a* by pulling on the zip tab 705*a* to open the zip fastener or other opening device 706*a* to separate the top piece from the top stack 702*a* and its corresponding bottom piece from the bottom stack of pieces 703*a*. The zip fastener or other opening device 706*a* and zip tab 705*a* can be located on either each top piece 702*a* of the top stack or on each bottom piece 703*a* of the bottom stack. The zip fastener or other opening device 706*a* and zip tab 705*a* can also be located on each top piece 702*a* of the top stack and simultaneously located on each bottom piece 703*a* of the bottom stack of pieces. The adhesive strips 708*a* attach the connecting strip to each piece 702*a* of the top stack of pieces and to each piece 703*a* of the bottom stack of pieces.

Figure 7C:
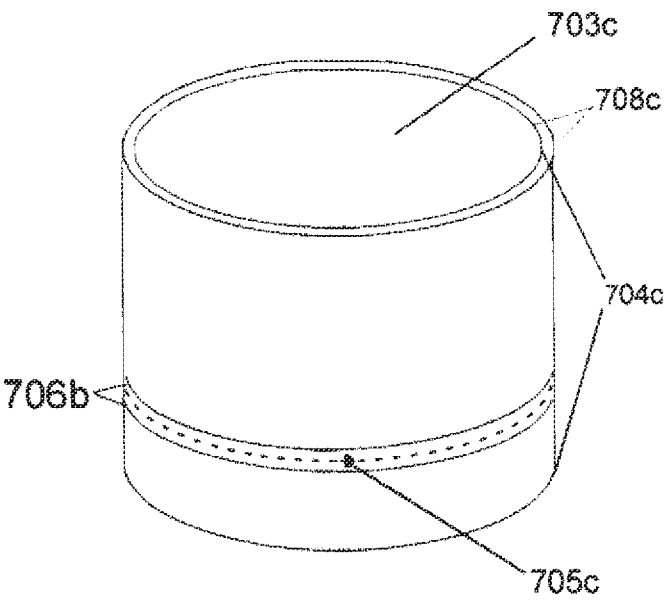
FIG. 7*c* shows an angled bottom view of an assembled stack of disposable pieces including the relationship of the zip track or other opening device on each adhering or attaching fold connecting each top piece to each attached bottom section around a rigid base according to various aspects and embodiments of the invention.
Figure 7B:
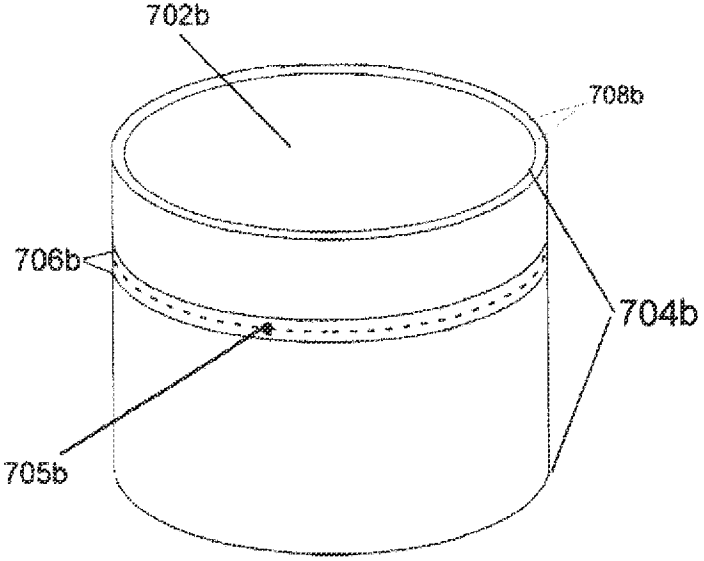
FIG. 7*b* shows an angled top view of an assembled stack of disposable pieces including the relationship of the zip track or other opening device on each successive adhering or attaching fold connecting each top piece to each attached bottom section around a rigid base according to various aspects and embodiments of the invention.

Now referring to FIG. 7*b* and FIG. 7*a*, according to various aspects and embodiments of the invention, FIG. 7*b* shows the assembled apparatus of FIG. 7*a* including the span of the connecting strip 704*b* from where it attaches to the top piece 702*b* by an adhesive strip 708*b*. The zip fastener or other opening device 706*b* and its zip tab 705*b* attach to the side of the stack of disposable pieces between each top piece 702*b* and each bottom piece (not shown).

Now referring to FIG. 7*c* and FIG. 7*a*, according to various aspects and embodiments of the invention, FIG. 7*c* shows the bottom view of the assembled apparatus of FIG. 7*a*. The adhesive strip 708*c* attaches the connecting strip 704*c* to each bottom piece in the bottom stack of pieces 703*c*. The zip tab 705*c* and zip fastener or other opening device 706*c* are shown on the side of the stack of disposable pieces.

Figure 8:
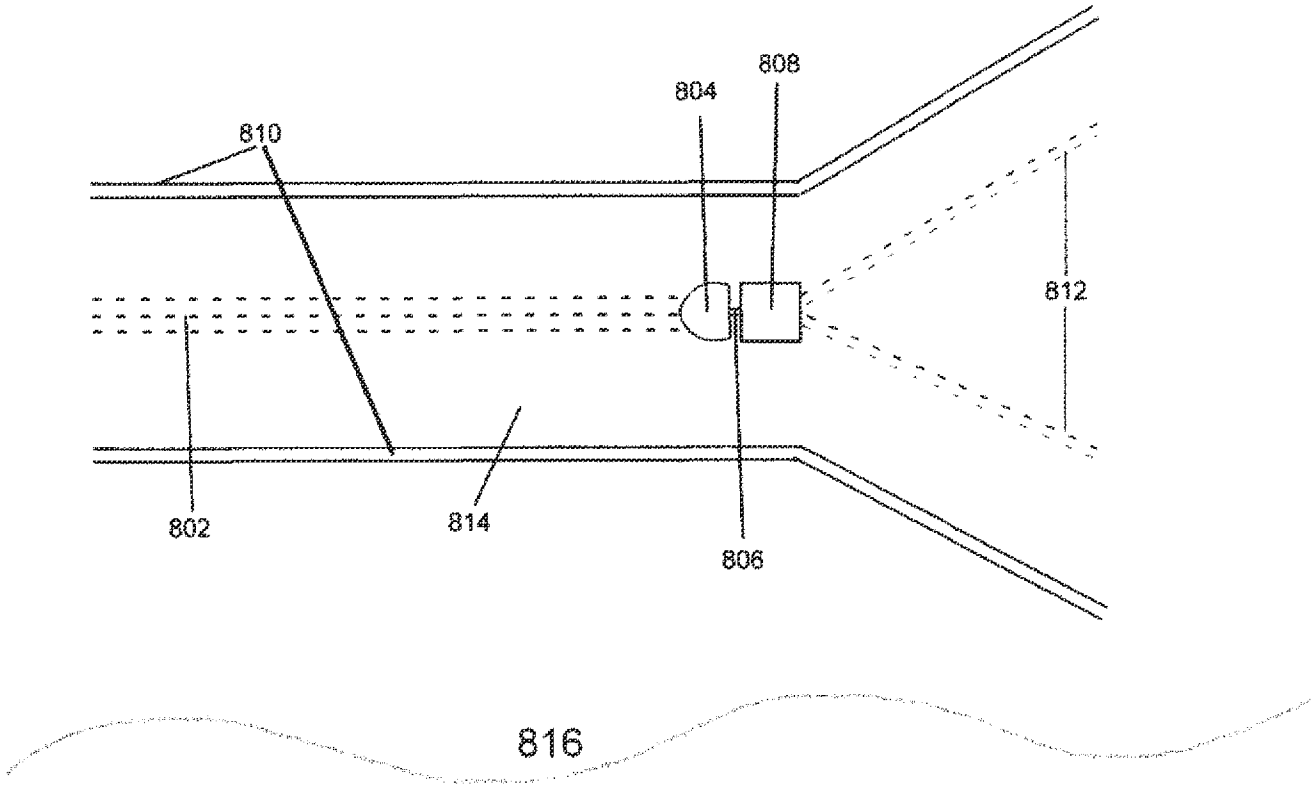
FIG. 8 shows the detail of a representative zip fastener, including adhesive strips, zip track, zip separator, zip connector, and zip tab for use on various aspects and embodiments of the invention.

Now referring to FIG. 8, according to various aspects and embodiments of the invention, a zip fastener may be attached to each connecting strip 816 by adhesive strips 810. The zip fastener includes a zip track 802, a zip tab 804, a zip connector 806, a zip separator 808, and adhesive strips 810. To remove a piece from a stack of disposable pieces, a user pulls the zip tab 804 to engage the zip connector 806. The zip connector 806 then engages and pulls the zip separator 808 along the zip track 802 which separates and opens 812 the zip track 802 to allow removal of the outermost piece from its respective stack of disposable pieces.

Figure 9:
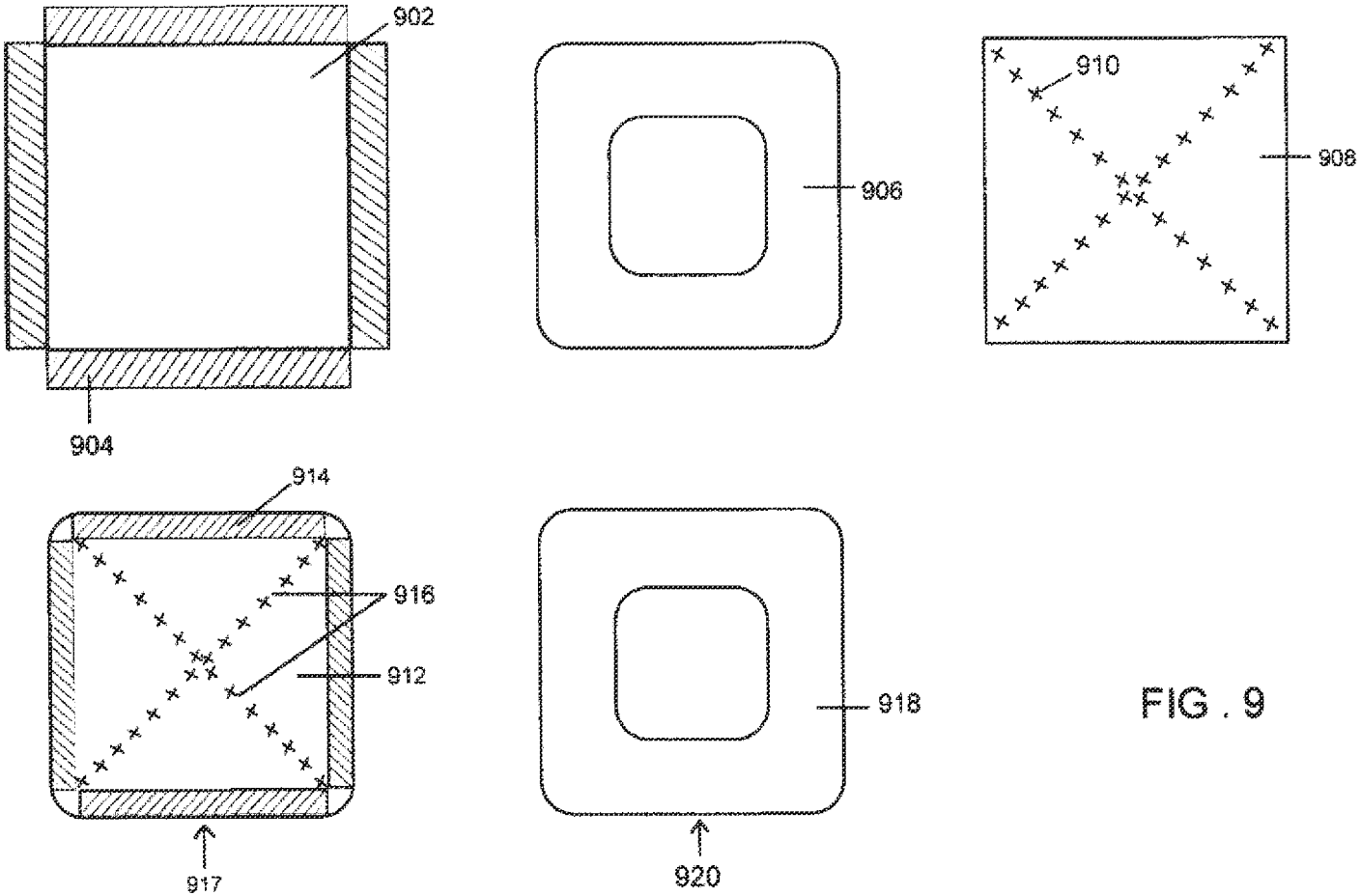
FIG. 9 shows the components of an embodiment of the invention that includes adhesive folds attached to its usable top piece and a cross-pattern zip track or other opening device embedded in the bottom section according to various aspects and embodiments of the invention.

Now referring to FIG. 9, according to various aspects and embodiments of the invention, the usable top piece 902 includes adhesive folds 904 extending from each of its edges. The rigid base 906 is in the center of the assembled stack of disposable pieces and is sandwiched between the usable top piece 902 and the bottom section 908. The bottom section 908 includes two zip tracks or other separating device 910, extending in an "X" pattern from each corner of the bottom section 908 to the opposite corner and crossing in center of the bottom piece 908. The adhesive folds 904 wrap past the edges of the rigid base 906, past any other assembled pieces in the stack of disposable pieces, and past the edges of the bottom section 908 and adhere to the bottom section 908 just inside its edges to form a completed stack of disposable pieces 917 (bottom view). The adhesive folds 904 are incrementally longer as more usable top pieces 902 and bottom sections 908 are incrementally added in an outward direction from their respective sides of the rigid base 906. The bottom view 917 shows the bottom section 908, 912 adhered adhesive strips 904, 914 and zip tracks other separating device 910, 916 extending from each corner of the bottom section 908, 912 and crossing in its center. The top view 920 or of a completed stack of disposable pieces shows only the usable top piece 902, 918.

In order for a user to remove a usable top piece 902, 918 from a stack of disposable pieces, the user would open the two zip tracks or other opening device 910, 916 from two corners of the bottom piece 908, 912, across the center of the bottom piece 908, 912 to the opposite corners of the bottom piece 908, 912. The user would then peel the bottom piece 908, 912, the adhering folds 904, 914 and the top piece 902, 918 from the stack of disposable pieces. The user would then remove the usable top piece 902, 918 from the adhering folds 904, 914. To remove the final top piece 902, 918 from the rigid base 906 the user would complete the same process.

Figure 10:
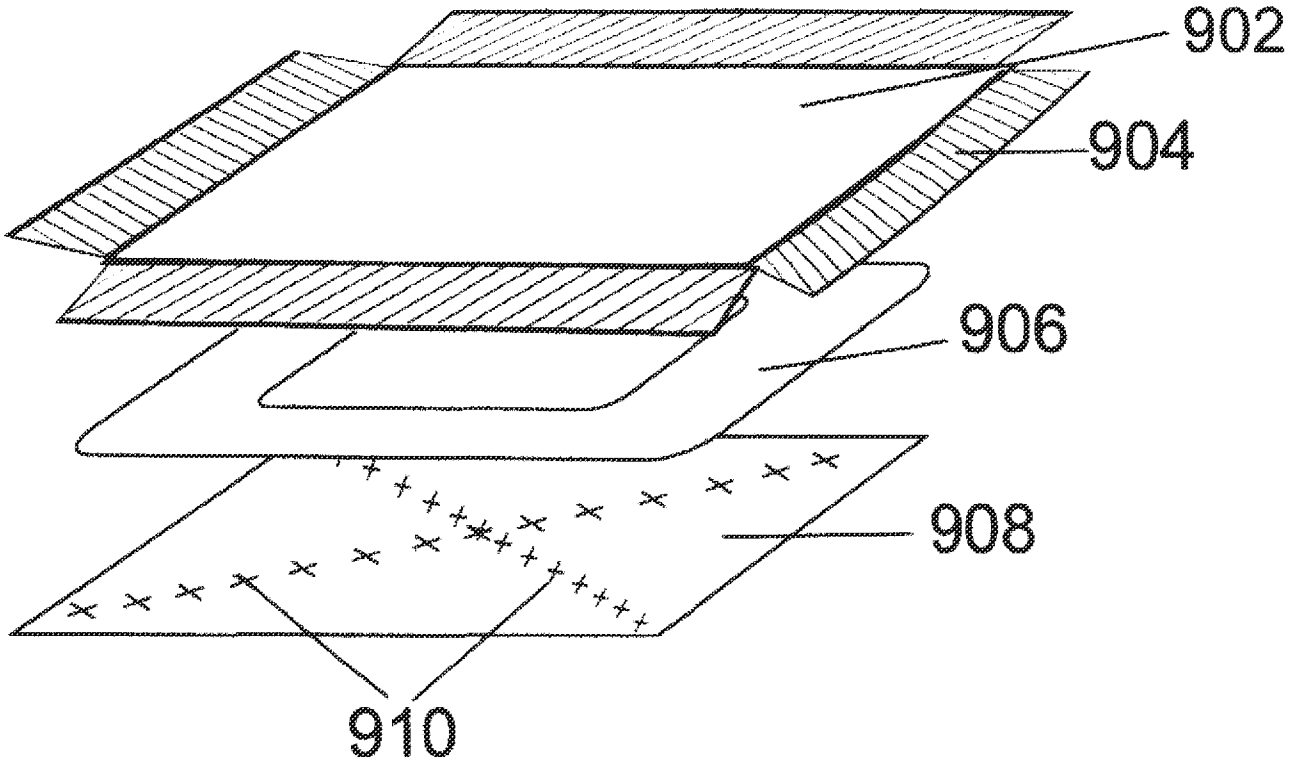
FIG. 10 shows an exploded view of FIG. 9.

Now referring to FIG. 10, FIG. 9, according to various aspects and embodiments of the invention, FIG. 10 shows the relationship of the sections of an embodiment of the invention before assembly of the apparatus. Usable top piece 902 is positioned above the rigid base 906 which is positioned above the bottom section 908. The adhesive folds 904 wrap past the edges of the base 906 and around the edges of the bottom section 908. The adhesive folds then adhere along the edges of the bottom section 908. To remove a usable top piece 902 from the apparatus, a user must open the zip tracks or other opening device 910, peel away the open bottom section 908 and the adhesive folds 904.

Figure 11:
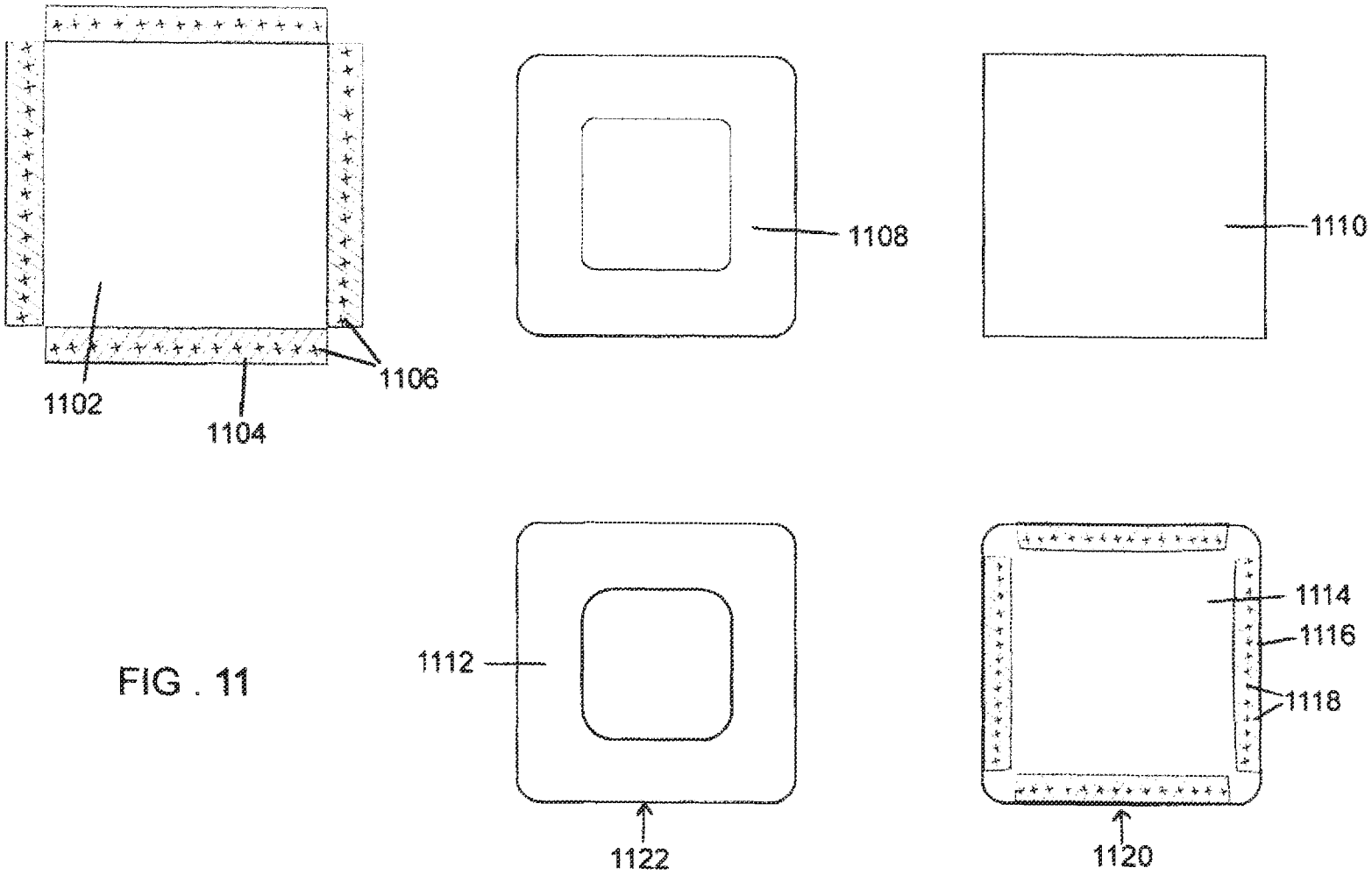
FIG. 11 shows the components of an embodiment of the invention that includes a usable top piece with attaching folds that include zip tracks or other opening devices embedded along the lengths of the attaching folds according to various aspects and embodiments of the invention.

Now referring to FIG. 11, according to various aspects and embodiments of the invention, the usable top piece 1102, includes adhesive folds 1104, extending from each of its sides. The adhesive folds 1104 include a zip track or other separating device 1106, located along the length of each adhesive fold 1104. The rigid base 1108 is in the center of the assembled stack of disposable pieces and is sandwiched between the usable top pieces 1102 and the bottom sections 1110. The adhesive folds 1104 wrap past the edges of the rigid base 1108, and past any other assembled pieces in the stack of disposable pieces, past the edges of the bottom section 1110, and fold onto the bottom edge of the bottom section 1110 where the adhesive folds 1104 adhere to the bottom section 1110 to form a completed stack of disposable pieces 1120 (bottom view). The bottom view 1120 of a completed stack of disposable pieces shows the adhesive folds 1104, 1116 adhered to bottom edge of the bottom section 1110, 1114, and the zip track or other opening device 1106, 1118, along the length of each adhesive fold 1104, 1116. The adhesive folds 1104, 1116 are incrementally longer as each additional usable top piece 1102 is incrementally added to one side of the rigid base 1108, and is adhered to each additional bottom section 1110 as it is incrementally added on the opposite side of the base 1108 to form a complete stack of disposable pieces. The top view 1122 of an assembled stack of disposable pieces shows the uppermost usable disposable piece 1102, 1112.

In order for a user to remove a usable top piece 1102, 1112 from a stack of disposable pieces, the user would open the four zip tracks or other opening devices 1106, 1118 from of the four adhesive strips 1106, 1116 attached to the edges of each bottom piece 1110, 1114. The user would then peel the detached bottom piece 1110, 1114, the connecting strips 1106, 1116 and the top piece 1102, 1112 from the stack of disposable pieces. The user would then remove the usable top piece 1102, 1112 from the adhesive strips 1104, 1116. To remove the final top piece 1102, 1112 from the rigid base 1108 the user would complete the same process.

Figure 12:
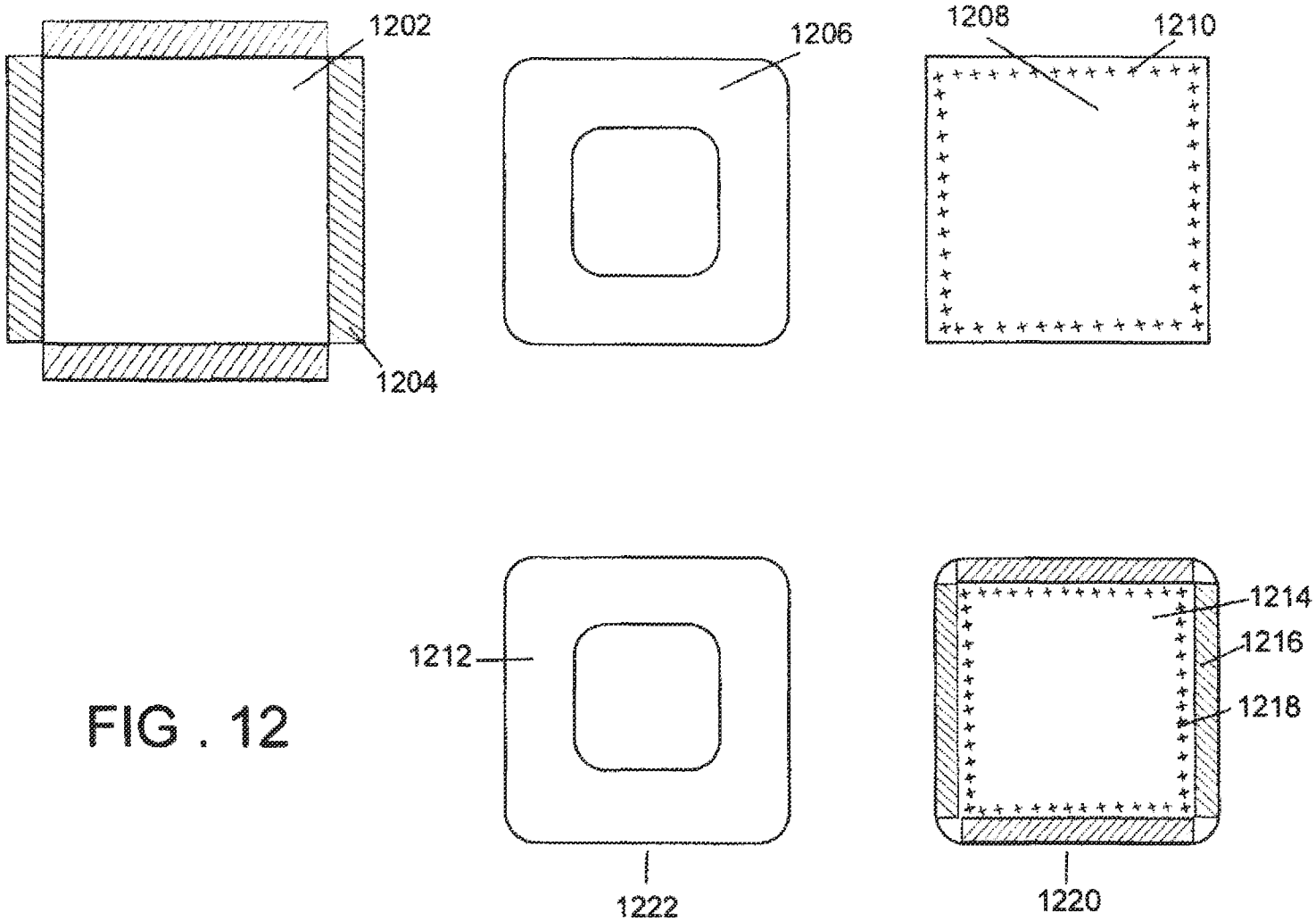
FIG. 12 shows components of an embodiment of the invention that includes adhesive folds attached to its usable top piece, and also zip tracks or other opening devices embedded around the perimeter of the bottom section according to various aspects and embodiments of the invention.

Now referring to FIG. 12, according to various aspects and embodiments of the invention, the usable top piece 1202, includes adhesive folds 1204, extending from each of its sides. The rigid base 1206 is in the center of an assembled stack of disposable pieces and is sandwiched between the usable top piece 1202 and the bottom section 1208. The bottom section 1208 includes zip tracks or other separating device 1210, located alongside and parallel to each edge of the bottom section 1208. The adhesive folds 1204 wrap past the edges of the rigid base 1206, past any other assembled pieces in the stack of disposable pieces, past the edge of the bottom section 1208, and then fold onto and adhere to the bottom edges of the bottom section 1208 between the edges of the bottom piece 1208 and the zip tracks 1210 to form a completed stack of disposable pieces 1220 (bottom view). The bottom view 1220 of a completed stack of disposable pieces shows the adhesive folds 1204, 1216 adhered along the length of each side of the bottom section 1208, 1214, between the edges of the bottom section 1208 and the four zip tracks or other separating devices 1210, 1218 embedded in the bottom section 1208, 1214. The zip tracks or other opening devices are parallel to the edges of the adhesive folds 1204, 1216. The adhesive folds 1204, 1216 are incrementally longer as each additional usable top piece 1202 is added to one side of the rigid base 1206, and is adhered to each additional bottom section 1208 on the opposite side of the rigid base 1206 to form a complete stack of disposable pieces. The top view 1222 of a stack of disposable pieces shows the top surface 1212 of a usable disposable piece.

In order for a user to remove a usable top piece 1202, 1212 from a stack of disposable pieces, the user would open the continuous zip track(s) or other opening device(s) 1210, 1218 embedded along the edges of each bottom piece 1208, 1214. The user would then peel the detached bottom section 1208, 1214, the connecting strips 1204, 1216 and the top piece 1202, 1212 from the stack of disposable pieces. The user would then remove the usable top piece 1202, 1212 from the adhesive strips 1204, 1216. To remove the final top piece 1202, 1212 from the rigid base 1206 the user would complete the same process.

Figure 13:
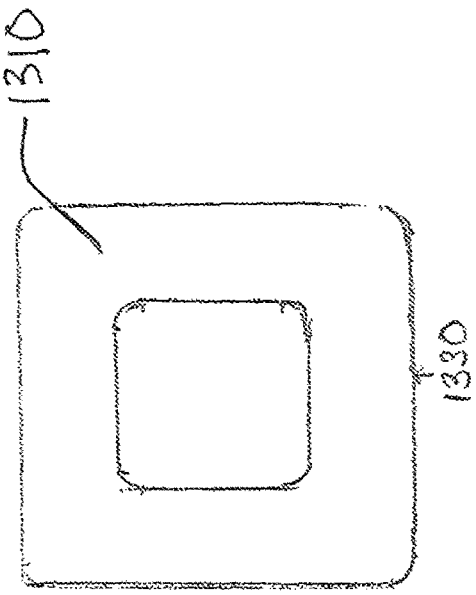
FIG. 13 shows components of an embodiment of the invention that includes non-adhesive attaching folds attached to its usable top piece, and zip tracks or other opening devices embedded along the lengths of adhesive/opening strips according to various aspects and embodiments of the invention.
Figure 13:
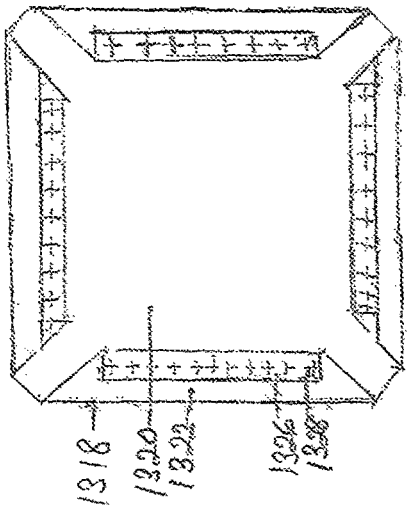
Figure 13:
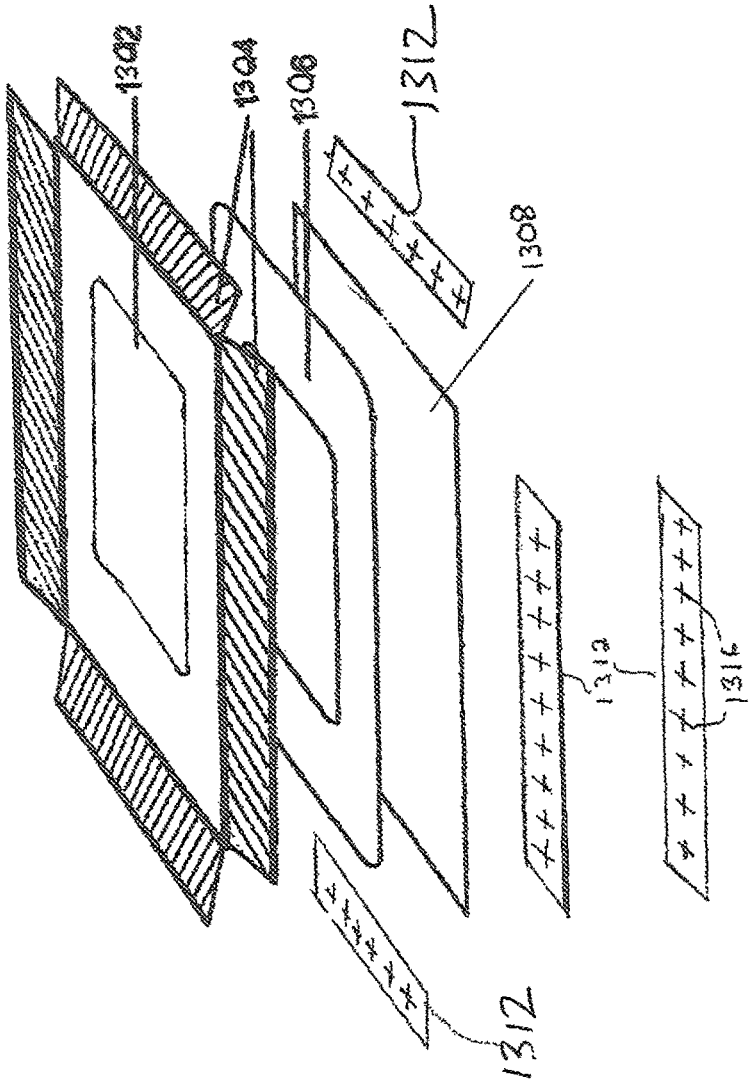

Now referring to FIG. 13, according to various aspects and embodiments of the invention, the usable top piece 1302, includes non-adhesive attaching folds 1304, extending from each of its sides. The rigid base 1306 is in the center of the assembled apparatus and is sandwiched between the usable top piece 1302 and the bottom section 1308. The non-adhesive attaching folds 1304 wrap past the edges of the rigid base 1306, past any other assembled pieces in the stack of disposable pieces and the edges of the bottom section 1308 and are adhered to the bottom section 1308 along its edges by adhesive/opening strips 1312 that include zip tracks or other separating device 1316 located in the center and running along each adhesive/opening strip 1312 to form a completed apparatus 1318 (bottom view). The bottom view 1318 of a completed stack of disposable pieces shows the non-adhesive folds 1304, 1322 adhered along the length of each edge of each side of the bottom section 1308, 1320, by adhesive/opening strips 1312, 1326. The adhesive/opening strips 1312, 1326 include a zip track or other separating device 1316, 1328 located along the length of each adhesive/opening strip 1312, 1326. The non-adhesive folds 1304, 1322 are incrementally longer as each additional usable top piece 1302, 1310 is added to one side of the rigid base 1306, and is adhered to each additional bottom section 1308 on the opposite side of the rigid base 1306 to form a complete stack of disposable pieces. The top view 1330 of a stack of disposable pieces shows the top surface 1310 of a usable disposable piece.

In order for a user to remove a usable top piece 1302, 1310 from a stack of disposable pieces, the user would open the four zip tracks or other opening devices 1316, 1328 embedded in each adhesive/opening strip 1312, 1326 that is adhered along the edges of each non-adhesive folding tab 1304, 1322 and each bottom piece 1308, 1320. The user would then peel the detached bottom piece 1308, 1320, the non-adhesive connecting strips 1304, 1322 and the top piece 1302, 1310 from the stack of disposable pieces. The user would then remove the usable top piece 1302, 1310 from the non-adhesive connecting strips 1304, 1322. To remove the final top piece 1302, 1310 from the rigid base 1306 the user would complete the same process.

Figure 14:
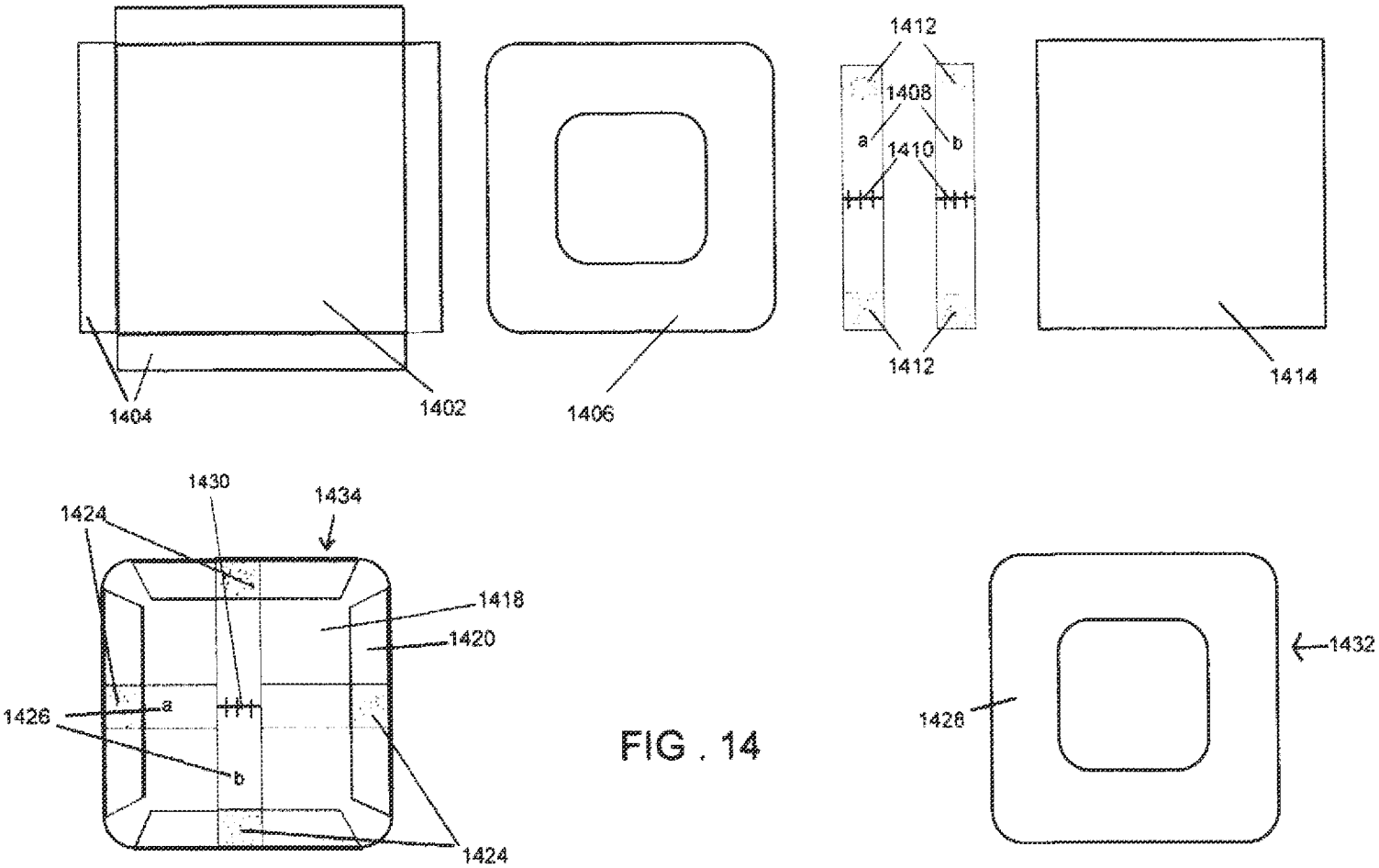
FIG. 14 shows components of an embodiment of the invention that includes non-adhesive attaching folds on its usable top piece, and zip tracks or other opening devices embedded across the centers of securing/opening strips that secure the non-adhesive attaching folds to the of the bottom section according to various aspects and embodiments of the invention.

Now referring to FIG. 14, according to various aspects and embodiments of the invention, the usable top piece 1402, includes non-adhesive attaching folds 1404, extending from each of its sides. The rigid base 1406 is in the center of the assembled stack of disposable pieces and is sandwiched between the usable top pieces 1402 and the bottom sections 1414. The non-adhesive attaching folds 1404 wrap past the edges of the rigid base 1406 and past any other assembled pieces in the stack of disposable pieces and fold onto the bottom edge of the bottom section 1414, 1418. The distal ends 1412, 1424 of the securing/opening strips 1408 (*a,b*), 1426 (*a,b*), which include zip tracks or other opening device 1410, 1430 across their midsections, adhere to the folded over non-adhesive connecting folds 1404, 1420 in a crossed pattern on the bottom section 1414, 1418 to form a completed stack of disposable pieces 1434 (bottom view). The bottom view 1434 of a completed stack of disposable pieces shows the non-adhesive connecting folds 1404, 1420, secured by the crossed securing/opening strips 1408, 1426 (*a,b*), and one zip track or other opening device 1410, 1430. The zip track or other opening device 1410, 1430 on the crossed over attaching/opening strip 1426*a* is hidden under the attaching/opening strip 1426*b* that crosses its center on the bottom section 1414, 1418. The non-adhesive attaching folds 1404, 1420 are incrementally longer as each additional usable top piece 1402 is incrementally added to one side of the rigid base 1406, and is attached to each additional bottom section 1414 as it is incrementally added on the opposite side of the base 1406 to form a complete stack of disposable pieces. The top view 1432 of an assembled stack of disposable pieces shows the uppermost usable disposable piece 1402, 1428.

In order for a user to remove a usable top piece 1402, 1428 from a stack of disposable pieces, the user would open the two zip tracks or other opening devices 1410, 1430 on the two securing/opening strips 1408, 1430 attached to the edges of the non-adhesive connecting folds 1404, 1420 folded over each bottom piece 1414, 1418. The user would then peel the opened securing/opening strips 1426*a* and 1426*b*, the bottom section 1414, 1418, and the non-adhesive connecting folds from the assembled stack of disposable pieces and remove the usable top piece 1402, 1428. To remove the final usable top piece 1402, 1428 from the rigid base 1406 the user would complete the same process.

Figure 15:
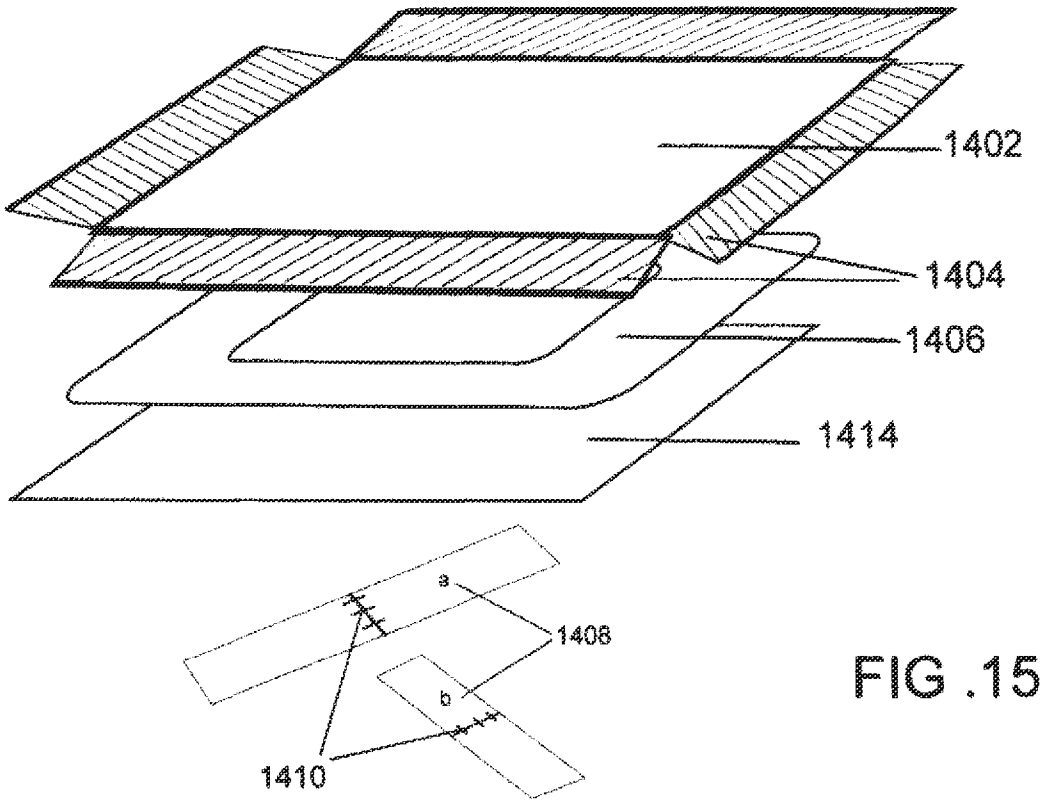
FIG. 15 shows an exploded view of FIG. 14 indicating the relationship of each component of an embodiment of the invention before assembly of the components according to various aspects and embodiments of the invention.

Now referring to FIG. 15 and FIG. 14, according to various aspects and embodiments of the invention, shows an exploded view of the relationship before assembly of the usable top piece 1402 with its attaching folds 1404, to the rigid base 1406, to the bottom section 1414 and to the securing/opening strips 1408 (*a,b*) with their respective zip tracks or other opening device 1410.

Figure 16:
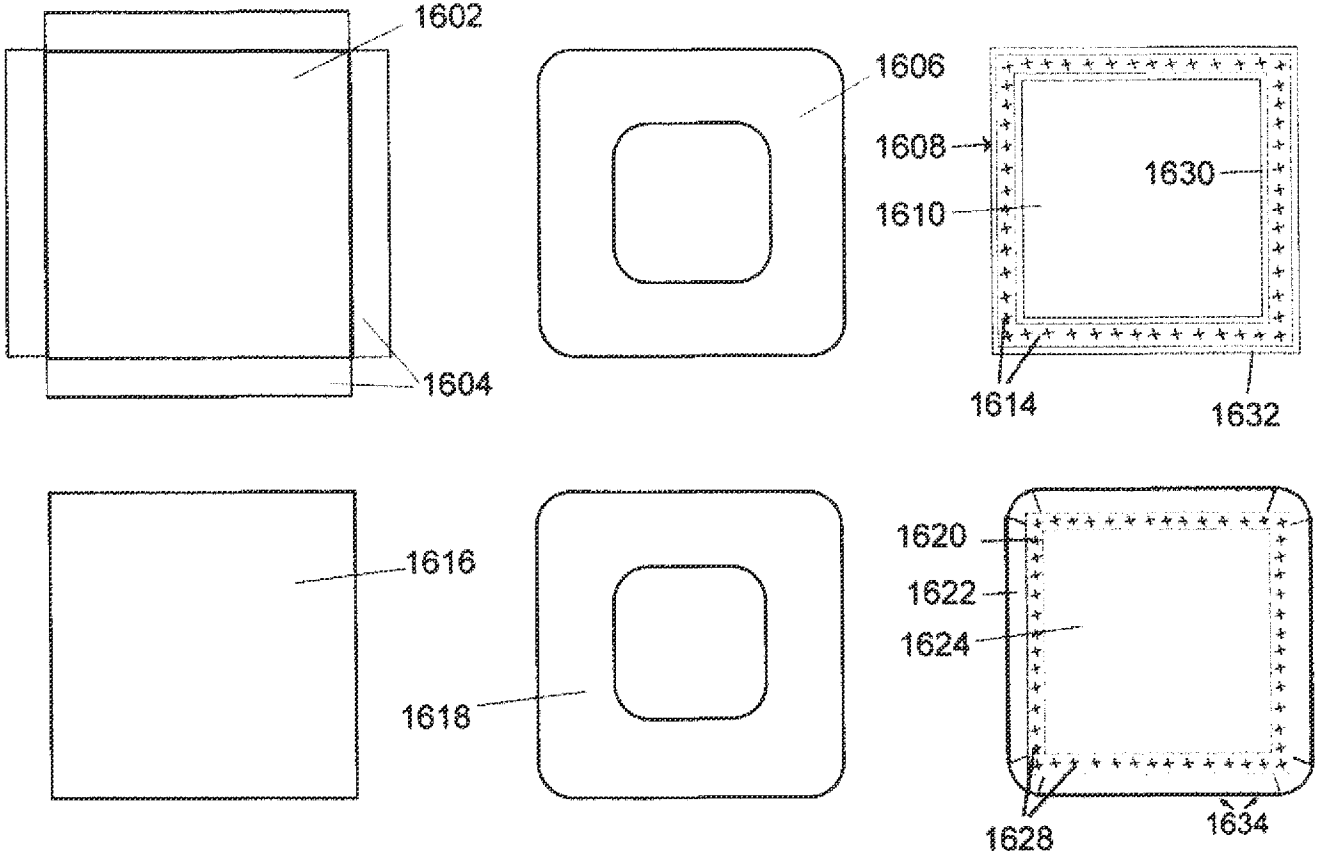
FIG. 16 shows components of an embodiment of the invention that includes non-adhesive attaching folds extending from its usable top piece, zip tracks or other opening devices embedded around an adhesive securing/opening frame that secures the non-adhesive attaching folds to the of the bottom section according to various aspects and embodiments of the invention.

Now referring to FIG. 16, according to various aspects and embodiments of the invention, the usable top piece 1602 includes non-adhering attaching folds that extend past the rigid base 1606, past any other assembled pieces in the stack of disposable pieces, and fold over the edges of the bottom piece 1616. The non-adhesive attaching folds 1604, 1622 are incrementally longer as each additional usable top piece 1602 is incrementally added to one side of the rigid base 1606, and is attached to each additional bottom section 1616 as it is incrementally added on the opposite side of the base 1606 to form a complete stack of disposable pieces. The securing/opening frame 1608, 1620 includes a zip track or other opening device 1614, 1628 running along the center of each of its four sides. The outside edge 1632 of the securing/opening frame 1608, 1620 adheres to the folded over non-adhering attaching folds 1604, 1622 along their edges. The inside edge 1630 of the securing/opening frame 1608, 1620 adheres to the bottom section 1616, 1624 just inside from the non-adhering attaching folds 1604, 1622. The securing/opening frame 1608, 1620 is open in its center 1610, through which the bottom section 1616, 1624 is visible. The bottom view 1634 of an assembled stack of disposable pieces shows the bottom section 1624, the non-adhering attaching folds 1622, the securing/opening frame 1620 with its zip track or other opening device 1628.

In order for a user to remove a usable top piece 1602, 1618 from a stack of disposable pieces, the user would open the zip track(s) or other opening device(s) 1614, 1628 that continues around the four sides of the securing/opening frame 1608, 1620. Once the four zip tracks or other opening devices 1614, 1628 are open, the folded over non-adhesive attaching folds 1604, 1622 can be removed from the bottom section. The user can then remove the bottom section 1616, 1624, and peel the non-adhering attaching folds 1604, 1622 away the usable top piece 1602, 1618. To remove the final usable top piece 1602, 1618 from the rigid base 1606 the user would complete the same process.

Figure 17:
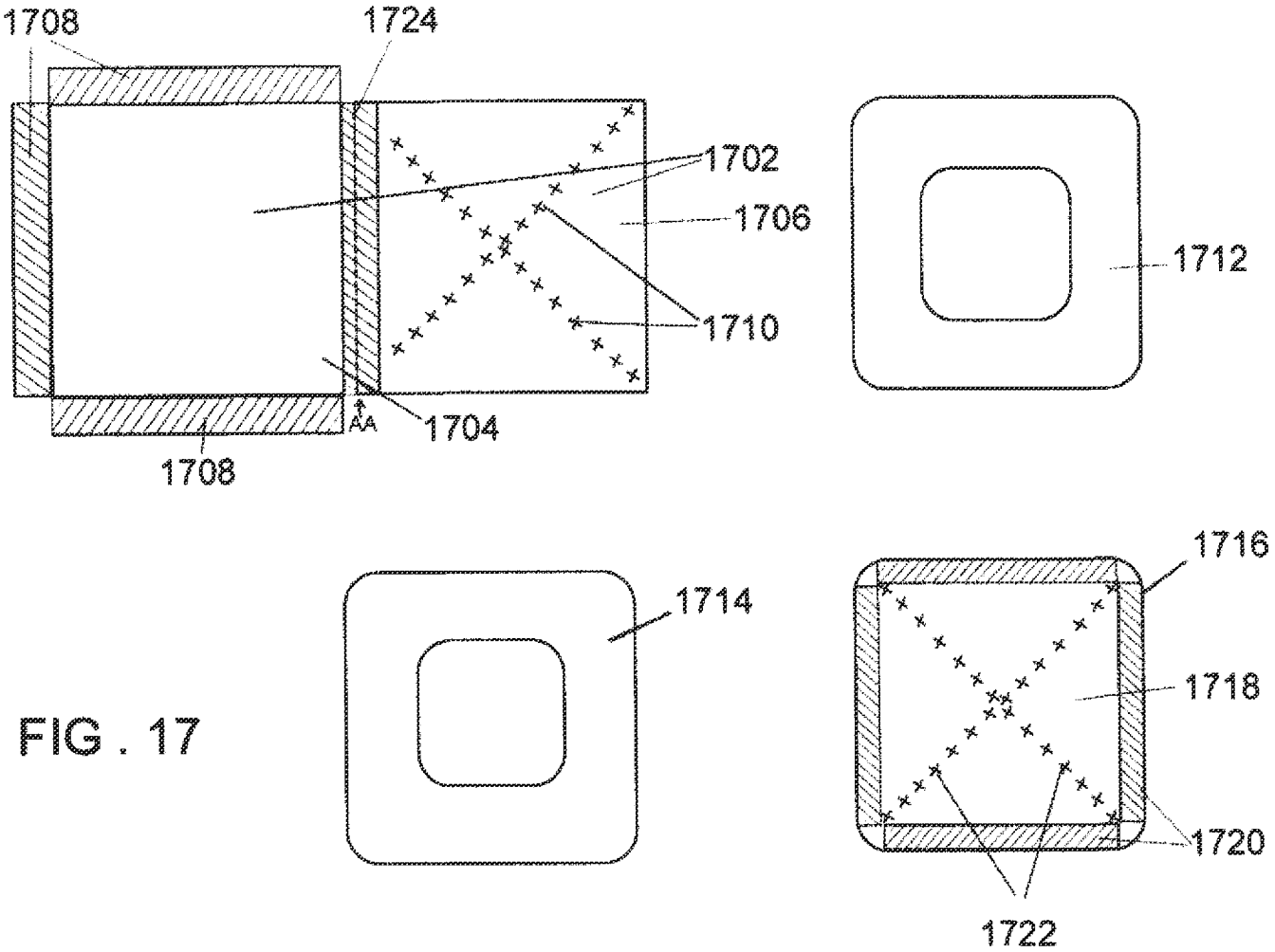
FIG. 17 shows components of an embodiment of the invention that includes a combination usable top piece with an attached bottom section. One adhesive attaching fold secures the usable top piece to the bottom section. The other adhesive attaching folds connected to the usable top piece that adhere around a rigid base attach to the bottom of the bottom section. Zip tracks or other opening devices are embedded in and extend from the corners of the bottom section and cross it in the center of the bottom section according to various aspects and embodiments of the invention.

Now referring to FIG. 17, according to various aspects and embodiments of the invention, the combined usable top piece and bottom section 1702 includes a usable top piece 1704, adhering folds 1708, 1724, and bottom section 1706 with crossed zip fasteners or other opening devices 1710. The adhering folds 1708 extend beyond the rigid base 1712, past any other assembled pieces in the stack of disposable pieces and adhere to the edges of the bottom section 1706, 1718. The fourth adhering fold 1724 is adhered to one edge of the bottom section 1706 before assembly of the stack of disposable pieces. The fourth fold 1724 can also be one piece with the top piece 1704 and the bottom section 1706 with a tear line AA that can be used to separate the top piece 1704 from the bottom section 1706. The adhering folds 1708, 1720, 1724 are incrementally longer as more usable top pieces 1702, 1714 and bottom sections 1706, 1718 are incrementally added in an outward direction from their respective sides of the rigid base 1712. The bottom view 1716 of the assembled stack of disposable pieces shows the bottom section 1706, 1718, and the two zip fasteners or other opening devices 1710, 1722 extending from each corner of the bottom section 1706, 1718 and crossing in its center. The view of the bottom section 1716 also shows the attached adhering folds.

In order for a user to remove a usable top piece 1704, 1714 from a stack of disposable pieces, the user would open the two zip fasteners or other opening devices 1710, 1722 from two corners of the bottom piece 1706, 1718, across the center of the bottom piece 1706, 1718 to the opposite corners of the bottom piece 1706, 1718. The user would then peel the bottom piece 1706, 1818, the connecting strips 1708, 1720, 1724 and the usable top piece 1704, 1714 from the stack of disposable pieces. The user would then remove the usable top piece 1702, 1714 from the adhesive folds 1708, 1720, 1724. To remove the final usable top piece 1704, 1714 from the rigid base 1712 the user would complete the same process.

Figure 18:
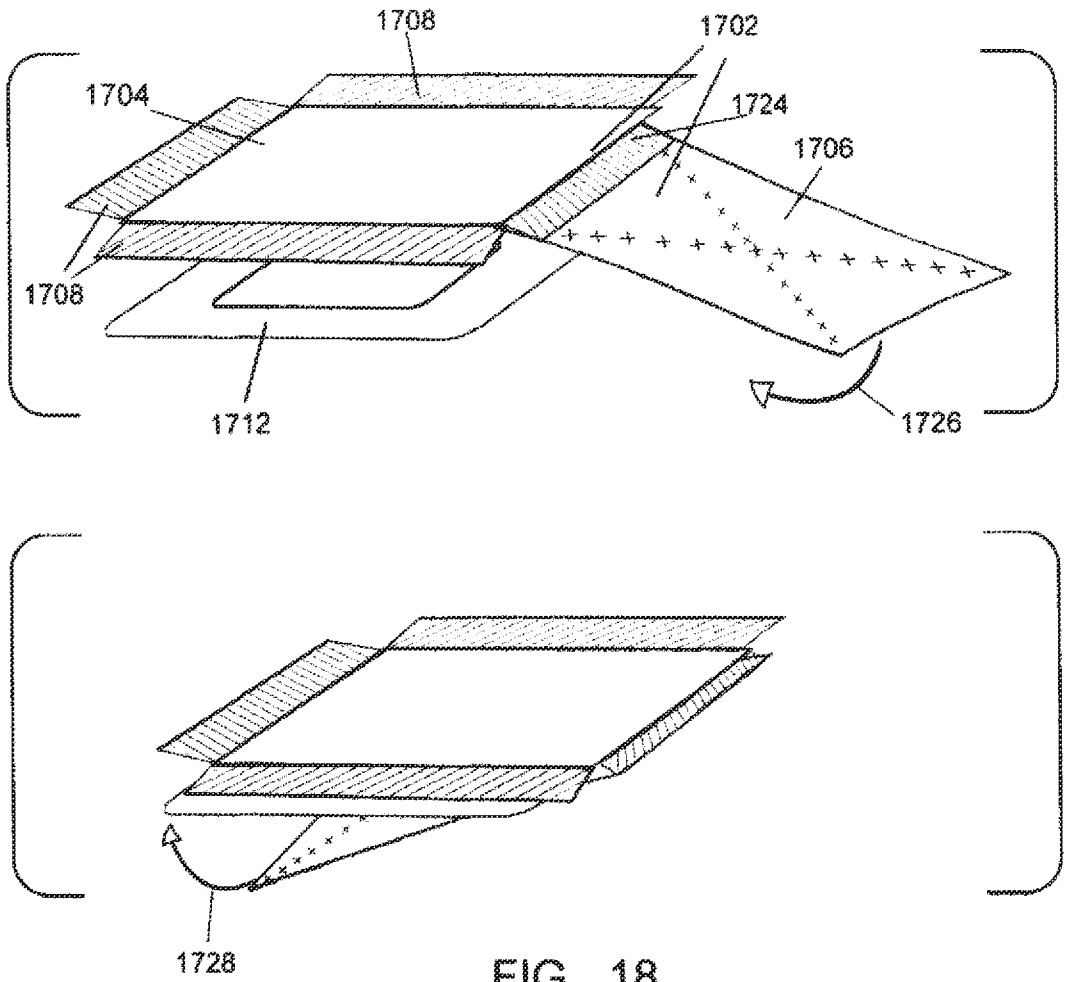
FIG. 18 shows two exploded views of the relationship of the components of FIG. 17 during the assembly of a stack of disposable pieces according to various aspects and embodiments of the invention.

Now referring to FIG. 18 and FIG. 17, according to various aspects and embodiments of the invention, shows the relationship of the components during assembly of the stack of disposable pieces. From the combined attached usable top piece and its attached bottom section 1702, 1704, 1706 the bottom section 1706 swings around from the level of the usable top piece 1704 on the attached adhering fold 1724 and encloses the rigid base 1712. Once bottom section swings 1726, 1728 into position under and adjacent to the rigid base 1712 the other three adhering folds 1708 fold down past the rigid base 1712 and adhere to the three unadhered edges of the bottom section 1706 forming a complete unit at the center of a stack of disposable pieces. Each additional combined top piece and bottom section 1702 in the stack of disposable pieces would wrap around the previously completed unit.

Figure 19:
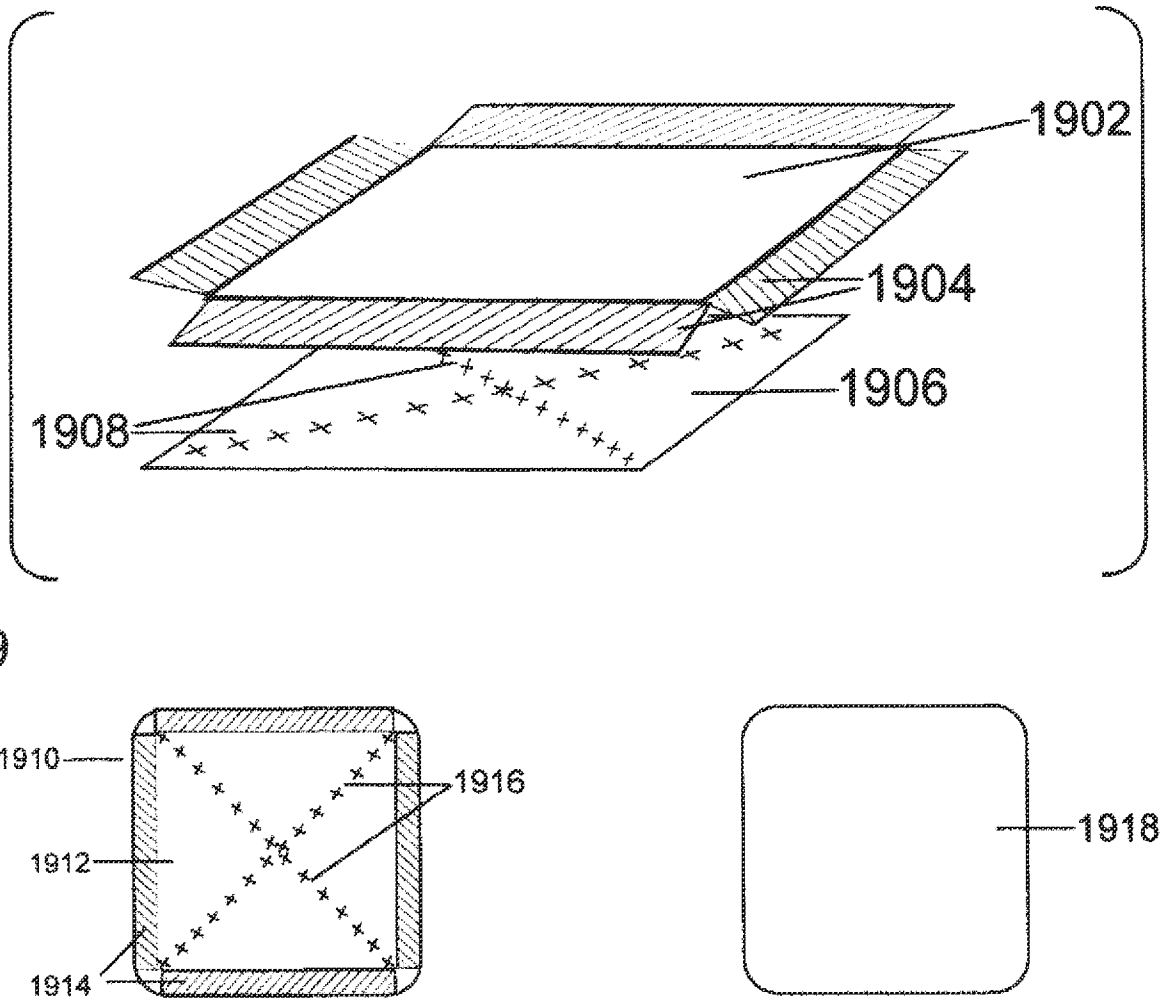
FIG. 19 shows the components of an embodiment of the invention that does not include a rigid base according to various aspects and embodiments of the invention.

Now referring to FIG. 19, according to various aspects and embodiments of the invention, the usable top piece 1902 includes adhering folds that wrap around the edges of the bottom section 1906 and adhere to its edges. The adhering folds 1904, 1914 wrap past any other assembled pieces in the stack of disposable pieces and fold past and onto the bottom edge of the bottom section 1906. The bottom section 1906 includes zip fasteners or other opening devices 1908 extending from its four corners and crossing in the center of the bottom section 1906. The bottom view 1910 of an assembled stack of disposable pieces shows the bottom section 1906, 1912, the zip fasteners or other opening devices 1908, 1916, and the folded over, adhered, adhering folds 1904, 1914. There is no rigid base in this embodiment of the invention.

In order for a user to remove a usable top piece 1902, 1918 from a stack of disposable pieces, the user would open the two zip fasteners or other opening devices 1908, 1916 from two corners of the bottom piece 1906, 1912, across the center of the bottom piece 1906, 1912 to the opposite corners of the bottom piece 1906, 1912. The user would then peel the bottom piece 1906, 1912, the adhering strips 1904, 1914 and the usable top piece 1902, 1918 from the stack of disposable pieces. The user would then remove the usable top piece 1902, 1918 from the adhesive folds 1904, 1914.

Figure 20:
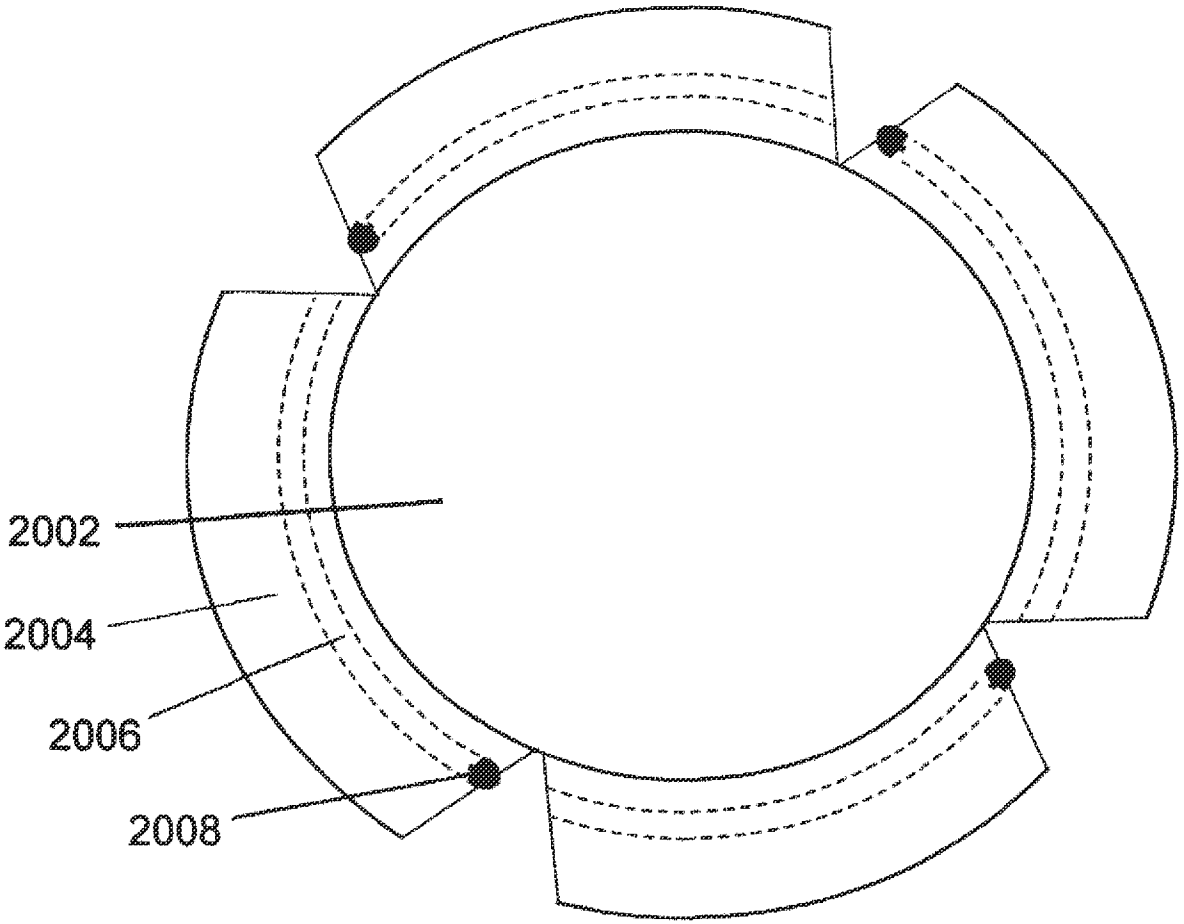
FIG. 20 shows the usable top piece of a round embodiment of the invention including its adhering folds and embedded zip tracks or other opening devices according to various aspects and embodiments of the invention.

Now referring to FIG. 20, according to various aspects and embodiments of the invention, shows a round version of a usable top piece 2002 with its adhering folds (or attaching folds) 2004 which include embedded zip fasteners or other opening devices 2006, including zip tabs 2008 that can be pulled to remove the usable top piece 2002.

All publications and patents cited in this specification are herein incorporated by reference as if each individual publication or patent were specifically and individually indicated to be incorporated by reference and are incorporated herein by reference to disclose and describe the methods and/or system in connection with which the publications are cited. The citation of any publication is for its disclosure prior to the filing date and should not be construed as an admission that the invention is not entitled to antedate such publication by virtue of prior invention. Further, the dates of publication provided may be different from the actual publication dates which may need to be independently confirmed.

Additionally, it is intended that such equivalents include both currently known equivalents and equivalents developed in the future, i.e., any elements developed that perform the same function, regardless of structure. The scope of the invention, therefore, is not intended to be limited to the exemplary embodiments shown and described herein.

Accordingly, the preceding merely illustrates the various aspects and principles as incorporated in various embodiments of the invention. It will be appreciated that those of ordinary skill in the art will be able to devise various arrangements which, although not explicitly described or shown herein, embody the principles of the invention and are included within its spirit and scope. Furthermore, all examples and conditional language recited herein are principally intended to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

Therefore, the scope of the invention, therefore, is not intended to be limited to the various aspects and embodiments discussed and described herein. Rather, the scope and spirit of invention is embodied by the appended claims.

The invention claimed is:

1. A stack of disposable plates comprising:

a rigid structure including an upper surface and a lower surface; and a plurality of layered plate pieces that removably attach to the upper surface of the rigid structure;

a plurality of disposable bottom pieces removably positioned to the lower surface of the rigid structure, wherein each plate piece of the plurality of layered plate pieces is paired with one disposable bottom piece of the plurality of disposable bottom pieces so that the number of the plurality of layered plate pieces is the same as the number of the plurality of disposable bottom pieces; and a plurality of non-adhesive attaching folds, each attaching fold including an adhesive/opening strip, wherein the adhesive/opening strip includes a separating device located along its length and each attaching fold attaches to and extends from one of the plurality of layered plate pieces, past the rigid structure, to corresponding edges of one of the plurality of disposable bottom pieces using the adhesive/opening strip to secure the non-adhesive attaching folds to the corresponding disposable bottom piece, wherein the non-adhesive attaching folds and the adhesive/opening strips removably secure the plurality of layered plate pieces and the plurality of disposable bottom pieces around the rigid structure for each pairing of one of the plurality of layered plate pieces with one of the plurality of disposable bottom pieces, and wherein the separating device is used to open and remove each paired plate piece and disposable bottom piece.

2. The apparatus of claim 1, wherein the plurality of layered plate pieces form a top stack including a top plate piece and a bottom plate piece, wherein the bottom plate piece of the top stack is removably attached to the upper surface of the rigid structure.

3. The apparatus of claim 2, wherein the plurality disposable bottom pieces form a bottom stack including a top disposable bottom piece and a bottom disposable bottom piece, wherein the top disposable bottom piece of the bottom stack is removably attached to the lower surface of the rigid structure.

4. A stack of disposable plates comprising:

a rigid base with two surfaces, including an upper surface and a lower surface;

a first stack of disposable plates, wherein each plate of the first stack of disposable plates includes edges and wherein a bottom disposable plate of the first stack of disposable plates is removably attached to the upper surface of the rigid base;

a second stack of disposable bottom sections wherein each section of the second stack of disposable bottom sections includes bottom edges and wherein an uppermost bottom section of the second stack of disposable bottom sections is removably attached to the lower surface of the rigid base; and non-adhesive attaching folds and each attaching fold including adhesive/opening strips, wherein each of the adhesive/opening strips include an opening device imbedded along each adhesive/opening strip's length and wherein the adhesive/opening strips attach to and extend from the edges of each plate of the first stack of disposable plates, past the rigid base, and adhere to the bottom edges of each corresponding bottom section of the second stack of disposable bottom sections using the adhesive/opening strips, wherein the rigid base is secured and located between the first stack of disposable plates and the second stack of disposable bottom sections using the non-adhesive attaching folds in conjunction with the adhesive/opening strips.

* * * * *